US006964237B2

(12) United States Patent
Hepp

(10) Patent No.: US 6,964,237 B2
(45) Date of Patent: Nov. 15, 2005

(54) GRATE BLOCK FOR A REFUSE INCINERATION GRATE

(75) Inventor: Mark P. Hepp, 32 Goss Rd., North Hampton, NH (US) 03862

(73) Assignee: Mark P. Hepp, Portsmouth, NH (US)

( * ) Notice: Subject to any disclaimer, the term of this patent is extended or adjusted under 35 U.S.C. 154(b) by 0 days.

(21) Appl. No.: 10/610,183

(22) Filed: Jun. 30, 2003

(65) Prior Publication Data

US 2004/0261674 A1 Dec. 30, 2004

(51) Int. Cl.[7] ..... F23H 3/00

(52) U.S. Cl. ..... 110/298; 110/299; 110/311; 110/348

(58) Field of Search ..... 110/267, 268, 110/281, 270, 288, 298, 299, 300, 309, 310, 311, 343, 348, 248

(56) References Cited

U.S. PATENT DOCUMENTS

| | | | | |
|---|---|---|---|---|
| 1,481,366 A | | 1/1924 | Herkenrath | |
| 2,745,364 A | | 5/1956 | Martin | |
| 3,014,439 A | * | 12/1961 | Mitchell et al. | 110/268 |
| 3,955,512 A | | 5/1976 | Martin et al. | 110/8 R |
| 4,006,693 A | | 2/1977 | Künstler | 110/8 R |
| 4,463,688 A | * | 8/1984 | Andreoli | 110/298 |
| 4,528,917 A | | 7/1985 | Jacobs | 110/300 |

(Continued)

FOREIGN PATENT DOCUMENTS

| | | |
|---|---|---|
| DE | 547 656 | 4/1932 |
| DE | 28 06 974 | 6/1979 |
| DE | 198 60 552 | 7/2000 |
| EP | 0 458 108 | 11/1991 |
| EP | 0 472 027 | 2/1992 |
| EP | 1 036 986 | 9/2000 |

*Primary Examiner*—Kenneth Rinehart
(74) *Attorney, Agent, or Firm*—Bowditch & Dewey, LLP

(57) ABSTRACT

A grate block for an incinerator has a top wall and a front wall that extends from the front wall. A pair of side walls wherein each sidewall extends from the top wall and the front wall. Each of the side walls of the grate blocks engage the side wall of the adjacent grate block. Each side wall has a recess in proximity to the front wall/upper wall interface. The recess defines a gap between the side walls of the adjacent grate blocks. An opening in the recess through the side wall allows for the flow of air from a cavity within the grate block. The slot created by the recess of the two adjoining grate blocks has a narrower slot opening created by a shallow upper recess and a broader slot opening created by a deeper lower recess. In that the openings are not directly aligned with any of the exposed surfaces, the air is required to make a perpendicular turn prior to exiting the recess of the grate block. This allows for sufficient pressure to drop across the surface of the grate block for a uniform distribution of primary air. Furthermore, the pressure drop makes it difficult to plug the opening with ash and debris by the change in direction. Furthermore, the deeper lower recess below the shallow upper recess creates a self-relieving channel.

22 Claims, 12 Drawing Sheets

U.S. PATENT DOCUMENTS

| | | | | | |
|---|---|---|---|---|---|
| 4,586,442 | A | | 5/1986 | Caughey | 110/229 |
| 4,600,380 | A | | 7/1986 | von Wedel | 432/58 |
| 4,672,947 | A | | 6/1987 | Martin | 126/163 |
| 4,676,176 | A | * | 6/1987 | Bonomelli | 110/281 |
| 4,771,710 | A | | 9/1988 | Cocchi | 110/281 |
| 4,876,972 | A | | 10/1989 | Mrklas | 110/298 |
| 5,050,510 | A | | 9/1991 | Vona et al. | 110/257 |
| 5,069,146 | A | | 12/1991 | Dethier | 110/281 |
| 5,081,939 | A | | 1/1992 | Esser | 110/276 |
| 5,241,916 | A | | 9/1993 | Martin | 110/348 |
| 5,271,339 | A | * | 12/1993 | Yamagishi et al. | 110/281 |
| 5,347,935 | A | | 9/1994 | Whitaker | 110/240 |
| 5,377,663 | A | | 1/1995 | Cole et al. | 126/152 B |
| 5,588,829 | A | | 12/1996 | Stahl et al. | 432/77 |
| 5,775,238 | A | | 7/1998 | Hauser | 110/282 |
| 5,899,150 | A | | 5/1999 | Martin et al. | 110/268 |
| 5,967,064 | A | | 10/1999 | Keldenich et al. | 110/276 |
| 5,983,811 | A | | 11/1999 | Keldenich et al. | 110/346 |
| 5,992,334 | A | | 11/1999 | von Wedel | 110/300 |
| 6,024,031 | A | | 2/2000 | Stiefel | 110/281 |
| 6,138,587 | A | | 10/2000 | Christmann et al. | 110/346 |
| 6,263,837 | B1 | | 7/2001 | Utunen et al. | 122/4 D |
| 6,513,445 | B1 | | 2/2003 | Forsberg et al. | 110/298 |
| 6,543,775 | B1 | | 4/2003 | Bell, Jr. | 273/348.4 |

* cited by examiner

GRATE BLOCK FOR A REFUSE INCINERATION GRATE

BACKGROUND OF THE INVENTION

As a result of changes in the composition of refuse or garbage, and particularly due to the increase in caloric value of such material, the combustion grate is exposed to high thermal stresses, particularly certain individual portions thereof. Furthermore, the operator of municipal waste mass burning applications typically has no control over the composition of the trash being fed into the system. At any given moment, one section of the grate can have a pile of wet yard waste while another section can have bags of high caloric or energy content plastic containers.

Due to the dual function of the combustion grate as a combustion support with ventilating means and also as a transfer or conveyance means for the material to be burned, the grate structure often includes such features as alternating fixed and movable grate sections and is a relatively complex multi-part structure. By having a uniform distribution of air beneath the grate, the basic design and operation ensures adequate oxygen for good combustion. The grate area and length is selected for sufficient residence time to allow for complete burnout, generally less than 2 percent unburned carbon content remains in the ash residue.

There are numerous factors in the combustion process that are monitored and/or attempted to be controlled. One such factor or boundary condition that is attempted to be controlled is the grate temperature. The specific control intervention involves establishing combustion temperature controls such that the average temperature of the grate layer does not exceed 300° C. with a combustion temperature of, for example, 1000° C.

Local overheating of the grate layer due to heat accumulation leads to increased corrosion and an increased scale formation rate. This results in excess wear of parts of the grate within a relatively short time and extensive annual maintenance. In these annual maintenance periods, large segments of grate parts are replaced.

One preventative measure for preventing high corrosion or scaling rates and the resulting increased mechanical wear which leads to the premature destruction of larger segments of grate block is provided by cooling off the grate blocks. There are several techniques for cooling including passing a coolant such as water through a chamber in the grate blocks and forcing air through the grate blocks. Generally, when cooling air is used, the cooling air is additionally used as the primary combustion air. Thus, the control of the primary combustion air is also a temperature control measure.

For forced cooling purposes, the under grate blast generally flows against the grate layer and air passage openings in the layer which allows part of the cooling medium to pass into the refuse bed to be burned where it participates in the combustion process as the primary combustion air. Clogging of the air openings leads to reduced flow and increased back pressure in the cooling air path and, consequently, to accumulation of heat at the particular point of the grate layer. This leads to thermal overstressing of the grate part, increased wear, higher scaling rates and, within a short time, the failure of portions of the grate.

SUMMARY OF THE INVENTION

It is recognized that the passing of air over the grate blocks does not sufficiently lower the temperature of the grate block to reduce the heat accumulated on the grate. It is also recognized that the ash and the trash that rest on the grate create an insulation layer between the grate and the actively burning trash.

It is also recognized that the movement of the movable grate block relative to the fixed grate blocks, in addition to moving the trash, also referred to as refuse or fuel, down the grate, creates spaces or voids that are absent of trash in that the trash is composed generally of material that does not fill voids well. The trash does not fill the voids for several reasons including the bulk density of the items, and the large size of some of the items. The trash and ash will form a bridge over the void.

The primary air stream from the grate block forms a turbulent eddy as the air circulates through the void on the top of the row at the face of the row above. It is recognized that the creation of voids in the trash and blowing of combustion air creates an area of increased oxygen that combines with the fuel, i.e., the trash, to create high temperatures, also referred to as a blacksmith furnace. This creates intense localized combustion subjecting the grate block to high temperatures.

It is also recognized as the moving row strokes forward, the air nozzles are blocked as the face presses into the trash and the area of increased oxygen no longer exists and the temperature drops. As the moving row strokes back, the void is created again on top of the fixed row at the face of the moving row. On top of the movable rows, the void is created and then the air nozzles blocked in the alternative stroke direction to that of the top of the fixed rows. This process continually causes thermal stress via intense combustion and cooling with each stroke.

This invention relates to an incinerator grate system. The system has a plurality of rows of fixed grate blocks and a plurality of rows of movable grate blocks between a pair of rows of fixed grate blocks. A reciprocal mechanism is connected to each of the rows of moveable grate blocks for moving the rows relative to the rows of the fixed grate blocks.

Each of the rows has a plurality of grate blocks. Each of the grate blocks has an upper wall, a front wall, and a pair of side walls. Each side wall extends from the top wall and the front wall. Each of the side walls of the grate blocks engage the side wall of the adjacent grate block. Each side wall has a recess in proximity to the front wall/upper wall interface. The recess defines a gap between the side walls of the adjacent grate blocks. An opening through the recess of the side wall allows the flow of air from a cavity within the grate block.

In a preferred embodiment, a foot is carried by the front wall and engages an upper wall of a grate block.

In a preferred embodiment, the recess on the side wall of the grate block has at least two levels, a shallow recess level and a deeper recess level, wherein the opening is on the deeper recess level, and the shallow recess level is interposed between the upper wall and the opening.

In one embodiment, each of the grate blocks include an angle corner edge wall interposed between the top wall, the front wall, and the pair of side walls. The angle corner edge minimizes the grate block cutting through the trash and results in greater movement of the trash by movement of the grate block.

In a preferred embodiment, the recess has an angle such that the stream of air exits from the grate block and forms an acute angle between 90 degrees above and 14 degrees below the plane of the top wall of the grate block.

In an alternative embodiment, each side wall has at least two recesses, each recess having an opening through the side wall for the flow of air from the cavity within the grate block. At least one recess on the side wall extends to the front wall, at least another recess on the side wall extends to the top wall, and at least another recess on the side wall extends to the angle corner edge wall.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
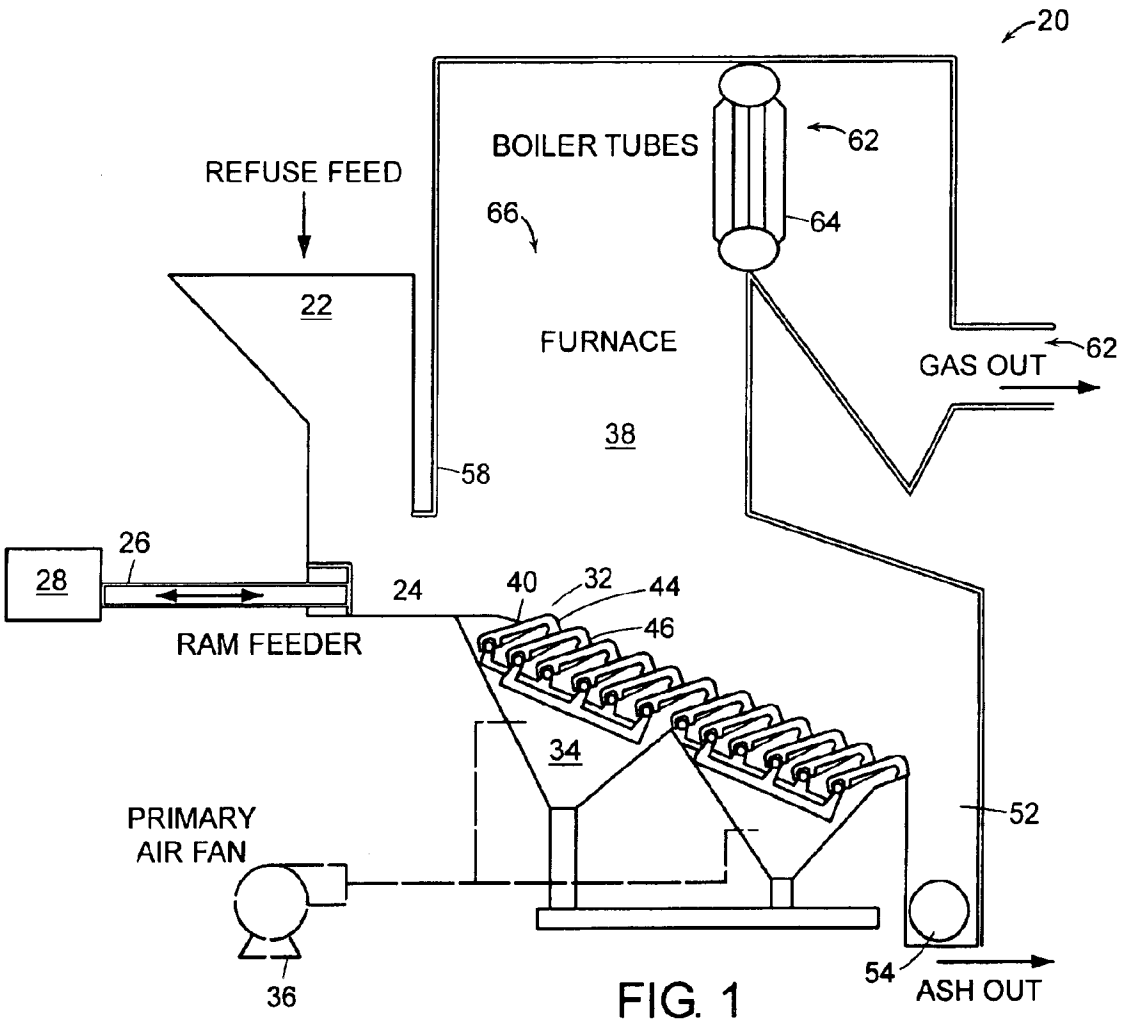
FIG. 1 is a schematic of a combustion furnace.

Referring to the drawings in detail, there is illustrated a grate block in accordance with the present invention designated generally as 40. In a preferred embodiment, the grate block according to the invention directs air flow to allow for generally uniform burning of trash or refuse without thermal stress caused by intense combustion and cooling.

Referring to FIG. 1, a combustion furnace 20 has trash, also referred to as refuse or fuel, fed via a refuse feed chute 22. The trash is typically not homogeneous and can include wet yard waste, non-combustible material, and high energy content or caloric material. The trash drops upon a feed table 24, on which a pusher ram 26 is moved back and forth by a drive 28.

The feed table 24 is adjoined at the same height by the start of a grate 32 having a plurality of grate blocks 40 which consists of fixed rows 44 arranged stepwise and movable rows 46 arranged in-between the fixed rows 44. The movable rows 46 are shown in FIG. 1 in a center position, in which the movable rows 46 are positioned over the fixed rows 44 arranged below them in between a retracted position and an extended position.

Underlying the grates 32 are a plurality of hoppers 34. Each of the hoppers 34 is capable of gathering any trash or ash that falls through the grate 32. It is not typical for large amounts of trash or ash to fall through the grate 32 unless one of the grate blocks 40 fails. In addition, each of the hoppers 34 is connected to an air source, such as a primary air fan 36 as seen in FIG. 1. The air from the air source passes through openings in the grate block 40, as described below, to a combustion chamber 38. FIG. 1 shows two hoppers 34, but the combustion furnace 20 typically has as many as four hoppers 34 in a trash conveying direction. Depending on the width of the combustion furnace, the furnace can typically have 1 to 6 hoppers in the direction perpendicular to the conveying direction. By means of a back and forth movement of the movable rows 46, the trash, i.e., the fuel, is moved slopingly downwards on the grate 42 until it drops, completely burned, into an ash receiver 52, from which the ash is transported away, for example, by means of a conveyor 54.

Figure 3A:
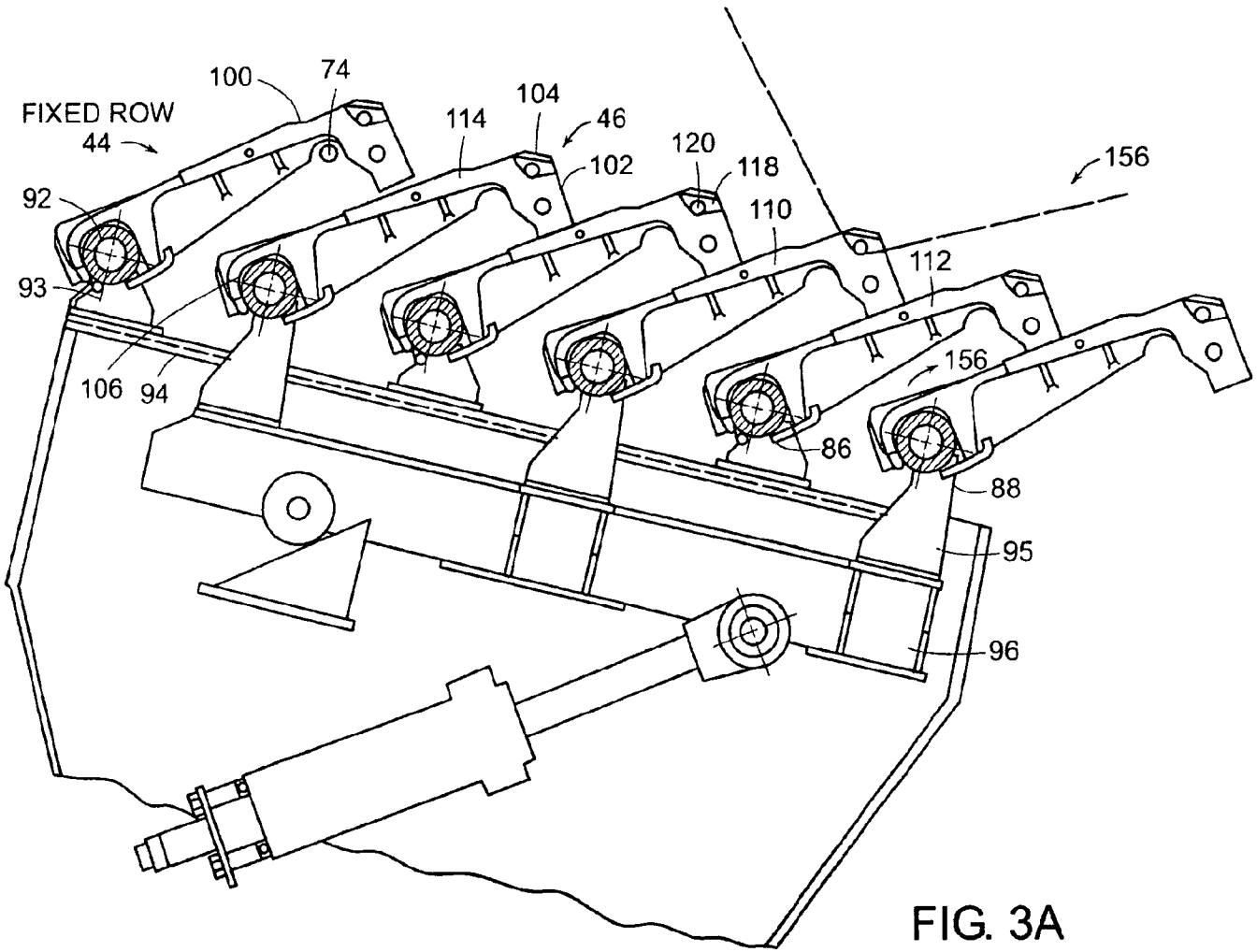
FIG. 3A is a partial side elevation, in partial section, illustrating grate blocks in accordance with the invention assembled in a grate layer.

The movement of the movable rows 46 is accomplished by hydraulics or a motor driven actuator as seen in FIG. 3A. The movable rows 46 over each hopper 34 are controlled as a unit and the units can each be controlled individually. The combustion furnace 20 can have the rate of movement of each section or unit of movable rows 46 be at a different rate.

For example, the trash introduced into the combustion furnace 20 can have a bulk density of 20 lbs/ft$^3$ and have the moveable blocks may move at a rate of 30 strokes per hour. As the trash is burned, the resulting ash is more compactable and the bulk density can increase to approximately 60 lbs/ft$^3$ just prior to dropping into the ash receiver 52. The movable rows 46 over the last hopper prior to the ash receiver 52 has a rate of 15 strokes per hour or less.

The combustion furnace 20 has the combustion chamber 38 arranged above the grate 42. The combustion chamber 38, on the left side of FIG. 1, towards the tray 24 and the pusher tray ram 26 is defined by a wall 58 which starts slightly above the start of the grate. The combustion gases reach an exit 60 of the combustion furnace 20 through a passage 62. Heat exchangers, such as the boiler tubes 64 as shown in FIG. 1, filters, and the like can adjoin the exit 18 of the boiler.

Referring to FIG. 1, the grate according to the present invention is designed such that the combustion takes place with primary air passing through the grate blocks 40 from the hoppers 34 as described below. Secondary air is admitted to the combustion chamber 38 above the grate 32 and the trash through the upper portion of the chamber such as represented by an arrow 66.

Figure 4:
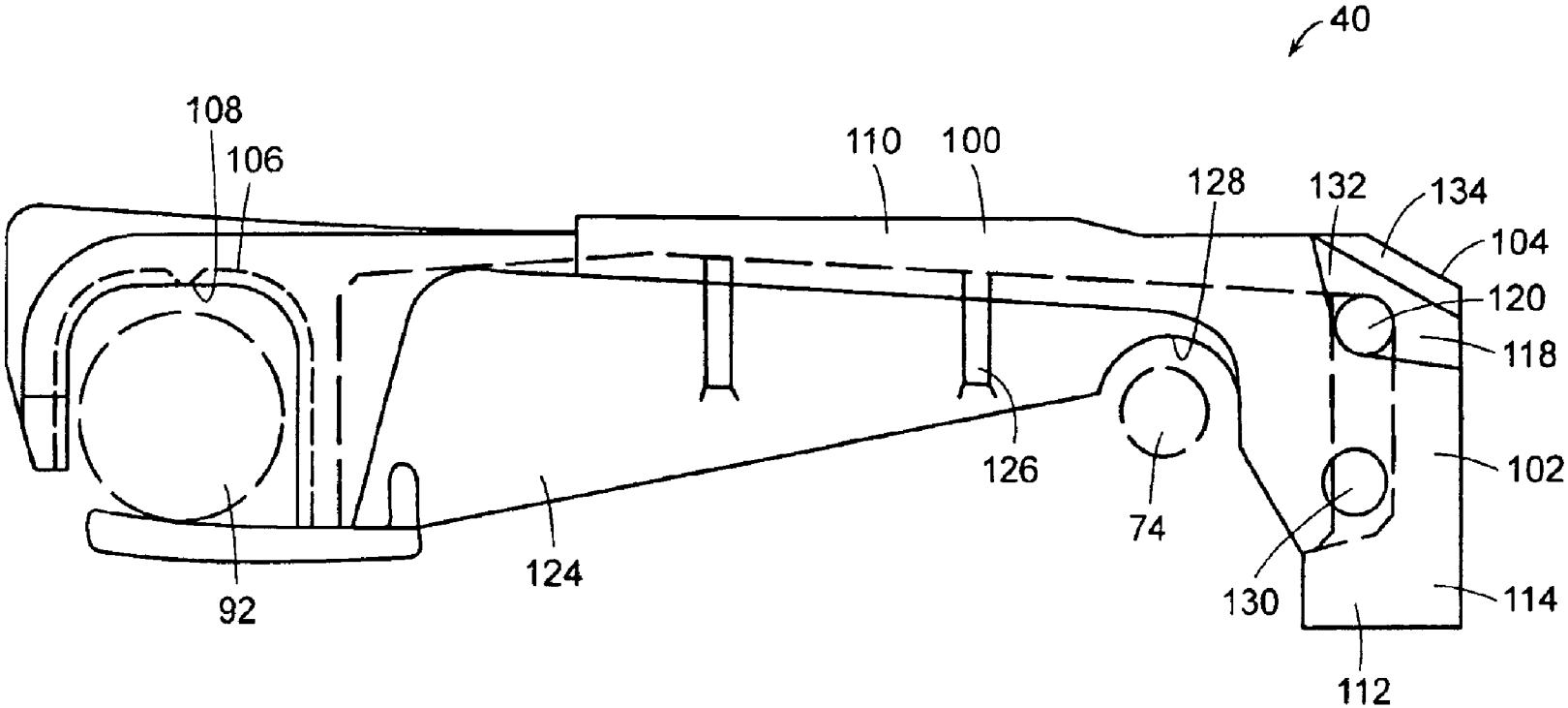
FIG. 4 is a side view of a grate block.

The combustion furnace 20 with the grate block 40 arrangement as described above operates with combustion air which passes through openings in the grate blocks 40 as described below. The combustion chamber 38 is under reduced pressure which causes combustion air from the hopper, which is under positive pressure by the primary air fan 36, to be forced through the openings 120 in the grate blocks 40 as seen in FIG. 4. Sharply defined combustion conditions can be set by means of proper air distribution.

In one embodiment, the combustion chamber 38 is at −0.1 inches of pressure. In addition, the maintaining of the combustion chamber at a negative pressure prevents smoke and exhaust from entering the building through penetration and openings in the combustion furnace and the hopper 22.

The combustion furnace 20, according to the invention, can preferably be designed with an after-burning chamber in which very high temperatures decompose any unburned pollutants thermally to produce harmless gases and are generated as a result of radiant heat and good insulation. The combustion furnace 20 can operate without an additional flame, due to the controlled trash feed and transport on the grate; the trash rate can be reliably controlled at any time, so that defined temperatures and combustion conditions can be achieved even with trash having widely varying properties. However, it is typical to have starter burners in order to have the combustion chamber 38 reach sufficient temperature prior to the introduction of trash for environmental reasons.

Figure 2:
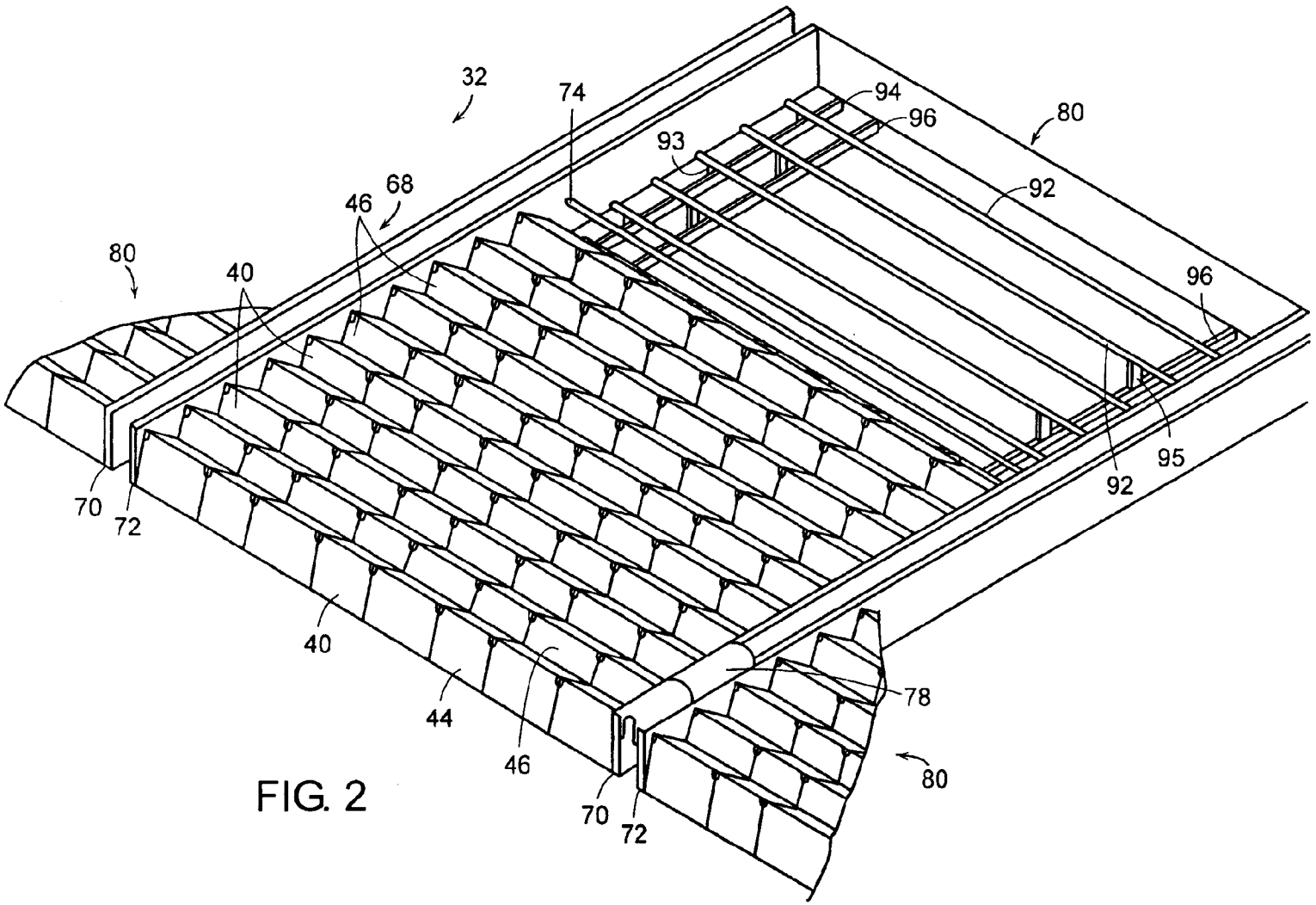
FIG. 2 is a perspective view of a portion of the grate blocks with a portion of the grate blocks removed.

The basic structure of the trash combustion grate 32 of this invention with its essential elements is shown most clearly in FIG. 2. FIG. 2 shows a portion of the grate 32 in a perspective view, with some of the grate block 40 removed. The grate 32 is sloped downwards in the direction of the conveyance, as represented by an arrow 68. The grate 32 can be formed of several modules 80 in the direction perpendicular to the conveying direction, wherein each module overlies a hopper. Each module 80 has a pair of side wall blocks 70 and 72 that are stably connected to each other by a plurality of tensioning rods 74. These tensioning rods 74 extend perpendicular and extend across the inside width between the pair of side wall blocks 70 and 72. The tensioning rods 74 are threaded at each end and extend through openings in the pair of side wall blocks 70 and 72. The tensioning rods 74 are secured to the pair of side wall blocks 70 and 72 by a plurality of nuts on the threaded ends. The tensioning rods 74 also serve as supporting rods for the group of stationary grate blocks 40 that receive the rod 74 through a support rib as explained in greater detail with respect to FIG. 3A. A shorter tensioning rod extends through the grate blocks 40 of the movable row 46 as explained below. A movable row 46 of grate blocks 40, moving in the direction opposite the conveyance, is located on the first fixed row 44. The front under edge of the grate blocks 40 of the movable row 46 rests on the grate blocks 40 of the first fixed row 44 below. The front under edge of the next highest fixed row 44 rests in turn on the movable grate blocks 40 and so on.

While the grate 32 is shown having a slope, such that there is a change in vertical height from one end to the other of the grate, it is recognized that the slope can be horizontal (i.e., having no slope.)

The side of each of the individual grate blocks 40 has a recess 118 with an opening 120, as seen in FIG. 4, through which the primary air for the combustion passes or is forced blown from below as described below in further detail.

When a plurality of modules each containing a plurality of grate blocks are placed together, the adjacent side wall blocks 70 and 72 of the adjacent modules are spaced by a slight gap. A cap 78 fills the gap. The grate blocks 40 for both the moveable rows 46 and the fixed rows 44 have a hook as seen in FIG. 4, that are each received by a respective block holding tube 92. The block holding tube 92 for the fixed rows 44 are each supported by at least a pair of support ribs 93. Each support rib 93 is carried by a support rail 94 as seen in FIG. 2 that extends parallel with the conveyance direction. Likewise the block holding tube 92 for the movable rows 46 are each supported by support ribs 95 and a carriage rail 96. The block holding tube 92, the support ribs 93 and 95 and the rails 94 and 96 are shown in further detail in FIG. 3A.

In one embodiment, a slight gap is formed adjacent to the last grate block 40 of each movable row 46 relative to the adjacent side wall blocks 70 and 72. In order to create the gap on the movable row, a shim is placed on the fixed rows so therefore all of the grate blocks 40 are the same width. In one embodiment, the first and the last grate block 40 on each row is slightly different to accommodate the securing of the tensioning rod to the support rib.

As indicated above with respect to FIG. 1, the area underneath the grate 32 has a plurality of hoppers 34. These hoppers define several distinct zones as represented by the grate modules 80. In addition to being able to vary the stroke rate of the movable rows 46, the hoppers are distinct in that the air flow underneath the grate can be adjusted to each region defined by the hoppers 34.

Primary air is blown into the individual zones by means of the primary air fan 36 with adjustable dampers, and this air then reaches the combustion chamber through the openings in the grate block 40 as described in greater detail below.

It is recognized that each hopper 34 can have separate ventilator fans and the volume of primary air can be regulated by varying the speed of the individual ventilators. This ability to vary the supply of primary air to the individual grate zones also helps to form a geometric fire in that the fire can be fed with exactly the required volume of air in a targeted and local manner.

As further illustrated in FIG. 3A, the combustion furnace 20 has the plurality of block holding tubes 92. The block holding tubes 92 for the fixed rows 44 are each supported by the support ribs 93 carried by the support rail 94. The block holding tubes 92 for the movable rows 46 are each supported by the support ribs 95 carried by the carriage rail 96. The grate blocks 40 are mounted on bearing means 92 which are supported on supports 94 and 96, and the blocks 40 being rotatable relative to the block holding tube 92.

As indicated with respect to FIG. 2, the movable rows 46 can be adjusted in stroke rate by the movement of the carriage rail 96 by the actuator 92. The carriage rail 96 is segmented related to a module such that each portion overlays a hopper in one embodiment.

The tensioning rods 74 are provided to support the blocks 40 and are coupled together so that the blocks are movable in groups and are combined together perpendicular to the longitudinal direction or the direction of conveyance of the grate assembly 32.

In the view shown, the tensioning rod 74 underlies a recess in the grate block with the exception of the end grate blocks in which the tension rod extends through a hole in the support rib to move the grate blocks of the movable row together. With respect to the tensioning rod for the fixed row of grate blocks, the tensioning rod extends between the two side wall blocks 70 and 72 as discussed above to compress the grate blocks. It is recognized that the grate block 40 could have a hole in each of the grate blocks in a securing device used to transfer loads from the tensioning rod to the support rib of the last block.

Still referring to FIG. 3A, the grate block 40 has an upper wall 100, a front wall 102, and an angle corner wall 104. In addition, the grate block has a projecting arm 106 that extends under the overlying grate block 40. The arm has a hook 108 that receives the support rod 92. The upper wall 100 has a thickened portion 110 on which a foot 112 of the front wall 102 of the block above moves relative to the lower block.

Still referring to FIG. 3A, the grate block 40 has a pair of side walls 114. The side wall has a recess 118, wherein the width of the grate block 40 is narrower than the remainder of the block 40. The recess 118 has an opening 120 through which primary air passes from under the grate blocks 40 and the area 122 in the hopper 34, as shown in FIG. 1.

The recess 118 in one embodiment directs the air in a flow pattern between an angle 90°, i.e., perpendicular, to the plane of the top wall 100 and an angle 14° below the plane of the top wall 100. The angle is such that the outflowing primary air just misses the lower adjacent grate block which is positioned in front of the opening. This flow pattern is illustrated in FIG. 3A wherein the stream 156, shown in dash-dot lines, emerges from the recess 118 and by-passes being directed against the upper wall 100 of the grate block 40 that underlies the block.

Figure 3B:
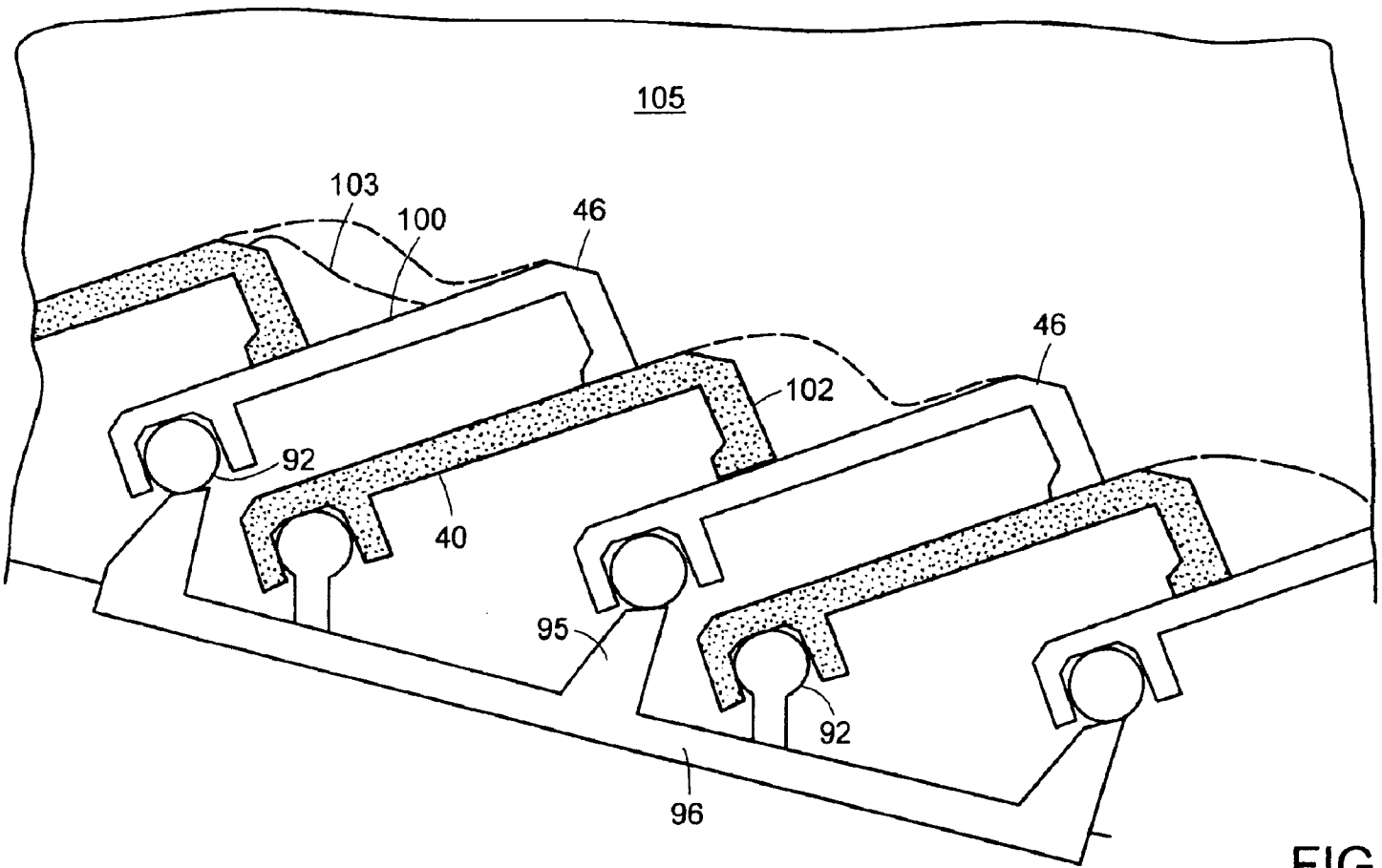
FIG. 3B is a schematic perspective view illustrating the movable rows of grate blocks in an extended position.

Referring to FIG. 3B, a view of the grate blocks 40 of the movable rows 46 are shown in an extended position. A portion of the trash 105 is shown in phantom to show the void 103 in front of the fixed rows 44. When the movable rows are in the retracted position, the void is in front of the front wall 102 of the moveable rows 46.

The directing of the primary air out of the grate block 40 in this upward direction accomplishes several things. The directing of the air flow in this direction prevents the blowing of combustion air into the voids at the face of the moving row created as the grate blocks of the moving row move backwards. Therefore, while the trash will continue to burn, this void does not get an increased amount of oxygen to create the blacksmith furnace. The movement of the movable row creating and eliminating the void does not therefore create rises and reduction in temperature at the front of the moving row face. In addition, the arrangement of the opening 120 and the recess 118 is explained in further detail with respect to FIGS. 4–7, also prevent the blocking of the opening with trash. As indicated above, as the trash moves down the grate 32, the composition of trash to burnt ash changes wherein the lower density, less space, filling trash is converted to a higher density ash that is capable of filling the void created by the movement of the grate blocks of the movable row.

As a result of the high pressure drop produced during the discharge of the primary air, the previously described selection of the cross-sectional area of the air outlets permits combustion of air distribution which is, to a greater or lesser extent, independent of the refuse layer thickness over the grate surface, leading to a relatively uniform combustion pattern.

Referring to FIG. 4, a side view of a grate block 40 according to the invention is shown. The grate block has the upper wall 100, the front wall 102, and the angle corner wall 104, which is interposed between the upper wall 100 and the front wall 102. The projecting arm 106 has the hook 108 for receiving the support rod 92 as shown in FIG. 3. Projecting from the upper wall 100 and engaging the front wall 102 is a support rib 124. Additional support ribs 126 run parallel to the front wall 102. The upper wall 100 has a thickened portion 110 upon which the foot 112 of the overlaying grate block 40 rests. The support rib 124 has a recess 128 formed in it to allow the tension rod 74, as seen in FIG. 3A, to extend. A tension rod 74 is shown in hidden line in FIG. 4, to show relative positioning. In addition to the opening 120 in the recess 118 of the side wall 114, the grate block has an alignment pin hole 130 for accepting an alignment pin for securing adjacent grate blocks together.

Figure 5:
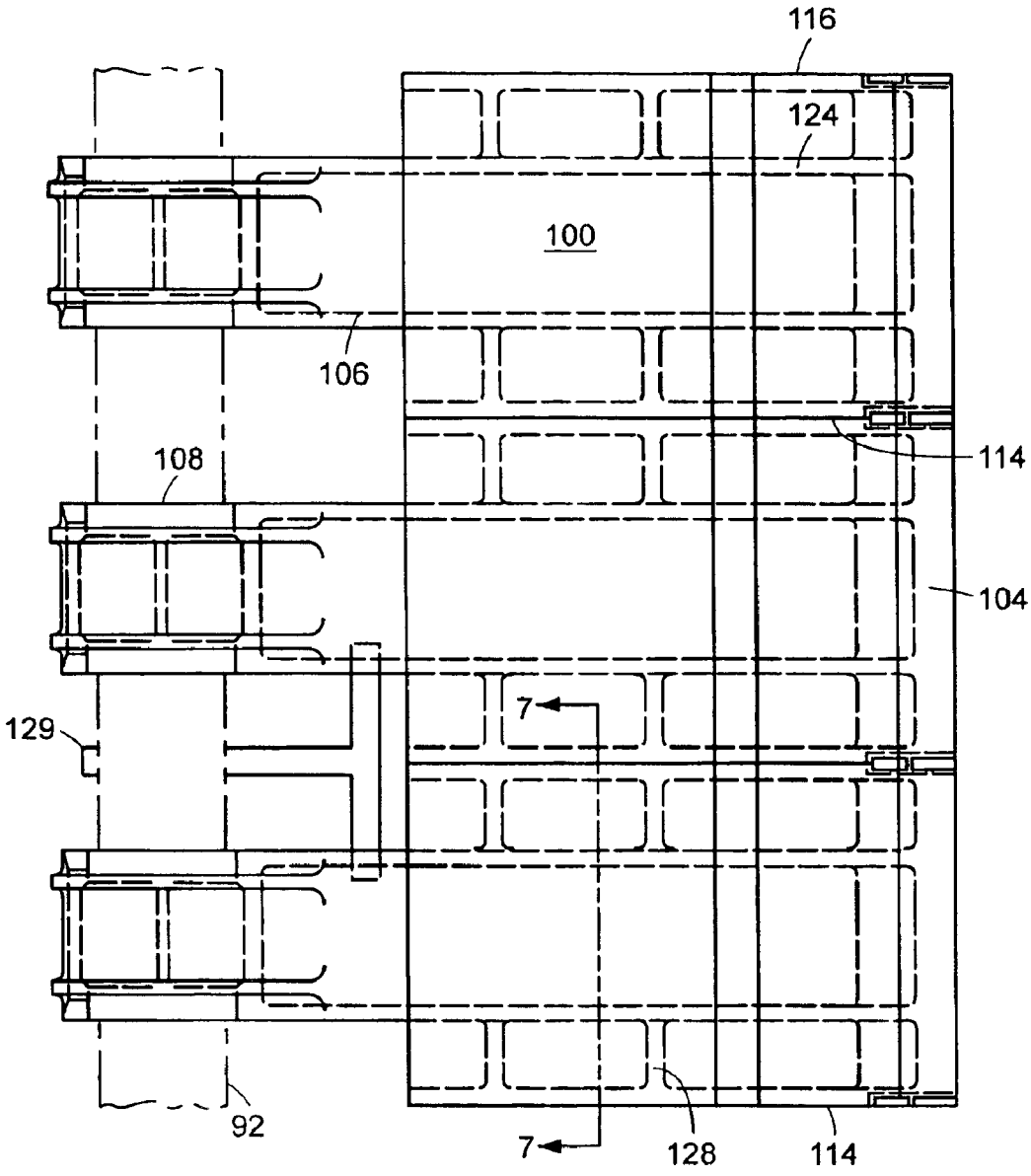
FIG. 5 is a top view of three grate blocks.

FIG. 5 is a top view showing three grate blocks 40 aligned with each other. While three grate blocks are shown in FIG. 5, it is more typical to have six to fifteen (15) grate blocks in a movable or fixed row as seen in FIG. 2. However, it is recognized that the number of grate blocks depends on several factors including the width of each block and the width of the unit. The projecting arm 106 is shown projecting from each upper wall 100 to the hook 108. The support ribs 124 and 126 are shown in the hidden line. The recess 118 is located at each of the side walls 114 and 116 of each grate block 40. The recess 118 extends from the upper wall 100, along the angle corner wall 104, and down to the front wall 102, as best seen in FIG. 6A.

The block holding tube 92 is shown in phantom line in FIG. 5. A retaining clip 129 extends from the support rib 124 of the projection arm 106 of two adjacent grate blocks and underlies the support pipe 92, as shown in FIG. 4.

Figure 6A:
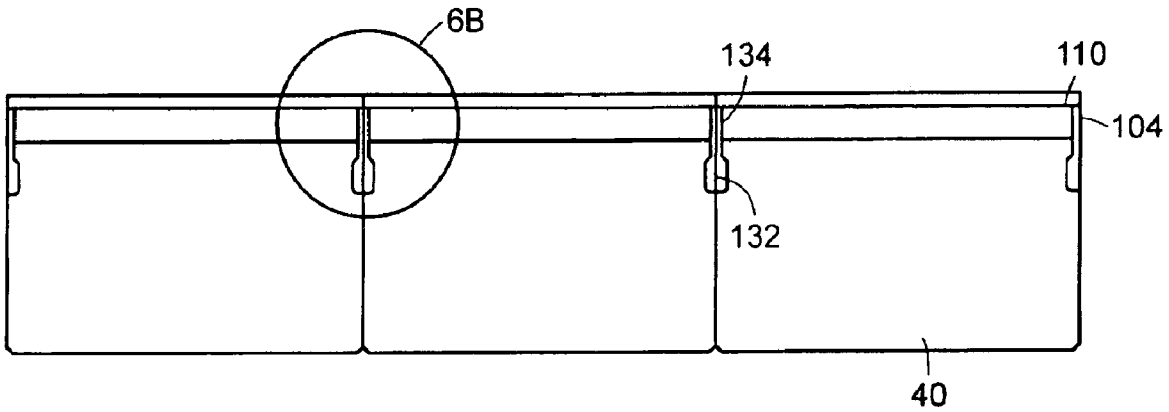
FIG. 6A is a front view of three grate blocks.
Figure 6B:
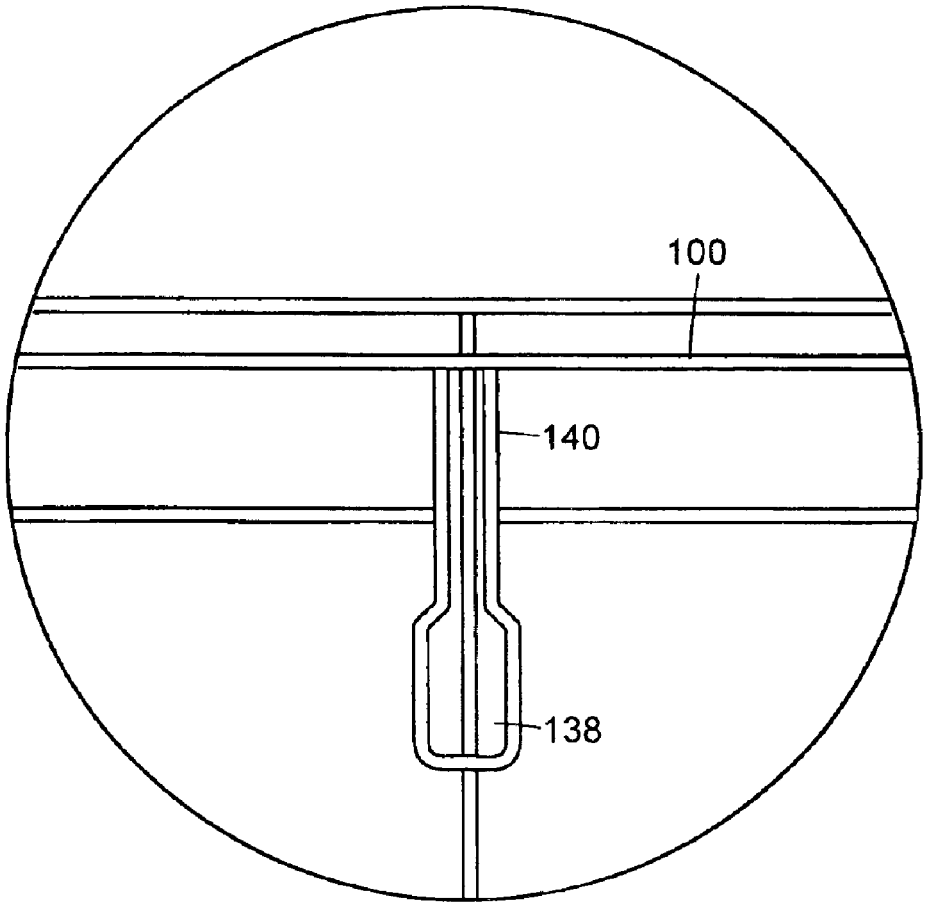
FIG. 6B is an enlarged view taken along 6B of FIG. 6A.

As seen in FIG. 6A, there is shown a front view of three grate blocks 40. The angle between the thickened portion 110 of the upper wall 100 and the lower portion of the upper wall 100 can be seen. In addition, the angle corner wall 104 is shown. The recess 118 has two levels; a deeper lower level 132 and a shallower upper level 134 as best seen in FIG. 6B. The shallower upper level 134 is in proximity to the angle corner wall 104, as seen in FIG. 4. When two adjacent grate blocks 40 are placed together, the adjacent recess 118 forms a broader opening 138 below the narrower opening 140 formed by the shallow upper recess 134. The openings 120 in each of the grate blocks 40 allow air to flow from the area 122 underneath the grate 42. FIG. 6B is an enlarged view of the interface of two grate blocks 40 showing the slot having a narrower slot opening 144, created by the shallow upper recess 134, and a broader slot opening 146, which is created by the deeper lower recess 132.

In that the openings 120 are not directly aligned with any of the surfaces of the upper wall 100, the front wall 102, or the angle corner wall 104, the air is required to make a perpendicular turn prior to exiting the recess 118 of the grate block 40. This allows for sufficient pressure to drop across the surface of the grate block for a uniform distribution of primary air. Furthermore, the pressure drop makes it difficult to plug the opening 120 "air nozzle" with ash and debris by the change in direction. Furthermore, the deeper lower recess 132 below the shallow upper recess 134, creates a self-relieving channel, wherein any ash or debris received in the narrower slot opening 144 created by the shallow upper recess 134, drops into the broader slot opening 146 created by the deeper lower recess 132, and is blown out by the opening in the front wall 102.

Furthermore, with the opening not being parallel to the front wall 102 of the grate block 40, the movement of the movable rows 46 does not result in the potential of the trash being mechanically forced into the opening by the movement of the grate block. For example, if a hard object aligns with the opening on a front wall because of the movement of the trash, the object such as a rod could force a piece of trash into the opening as the grate block of the movable row moves in proximity to the rod. The retracting of the movable row of grate blocks would not result in the trash being pulled back out of the closed opening.

The grate block 40 air exits at such an angle as to minimize any impinging and recirculation of the stream of air onto the adjacent grate block. This results in reducing local temperatures at the surface of the grate block 40 by not creating a blacksmith furnace.

Figure 7:
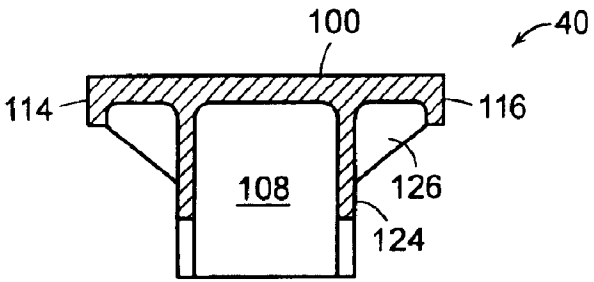
FIG. 7 is a sectional view of the grate block taken along the line 7—7 of FIG. 4.

FIG. 7 is a sectional view of the grate block 40. The support rib 124 projects downward from the upper wall 100. The support rib 126 projects outward from the support rib 124 to the side walls 114 and 116. The overall width of the grate block 40 narrows down in the area of the projection arm and the support hook 108 resulting in reduced weight. The grate block with its narrowed portion includes the support ribs 124 and 126 that provide strength and rigidity.

Figure 9:
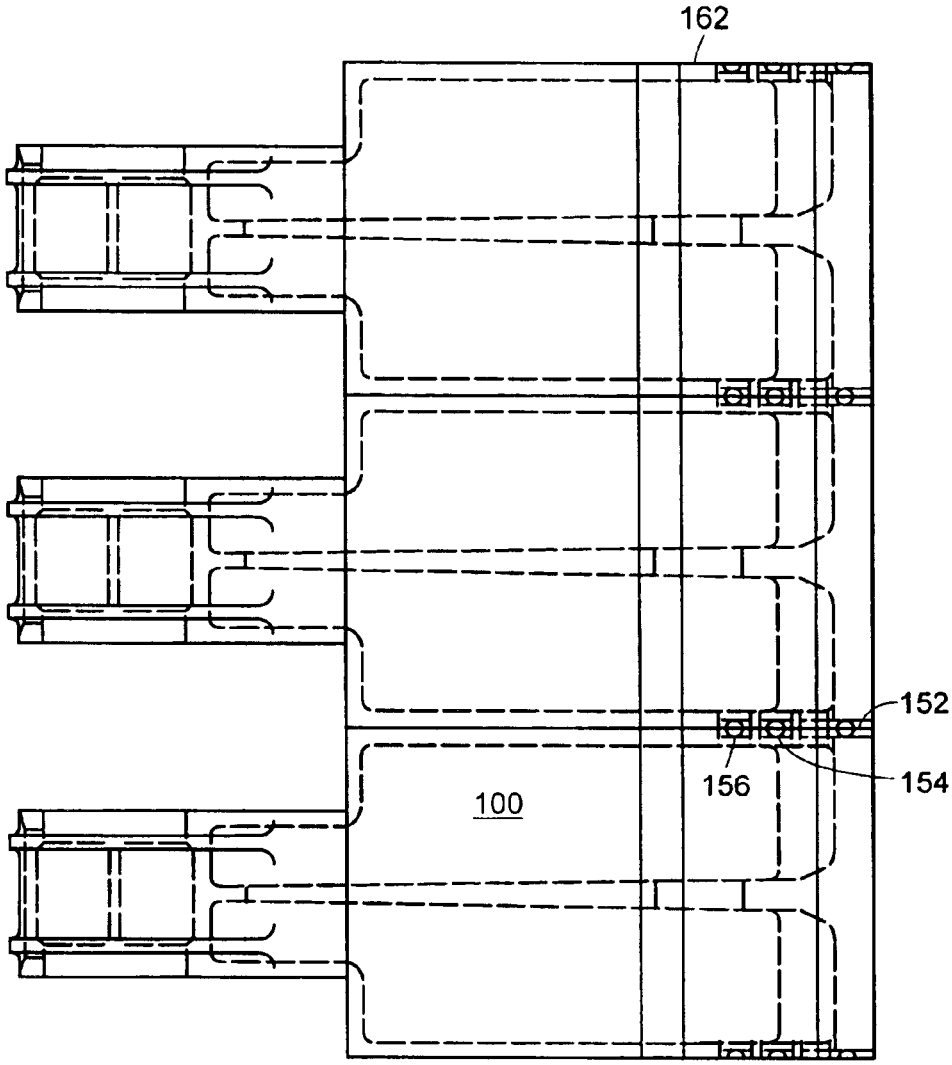
FIG. 9 is a top view of three grate blocks of FIG. 8.
Figure 8:
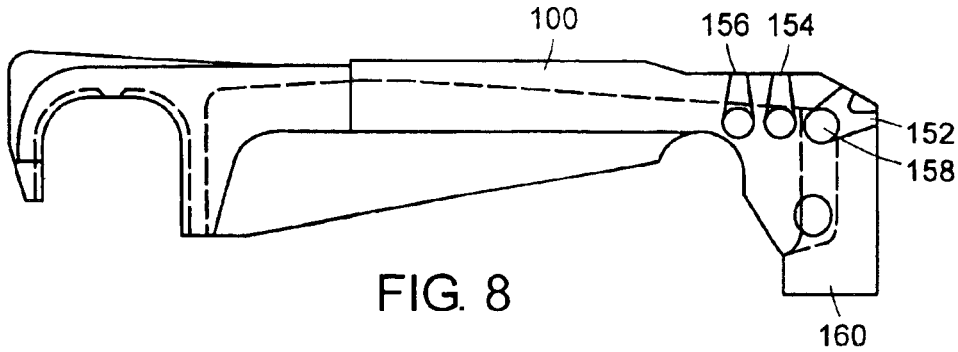
FIG. 8 is a side view of an alternative grate block.
Figure 10:
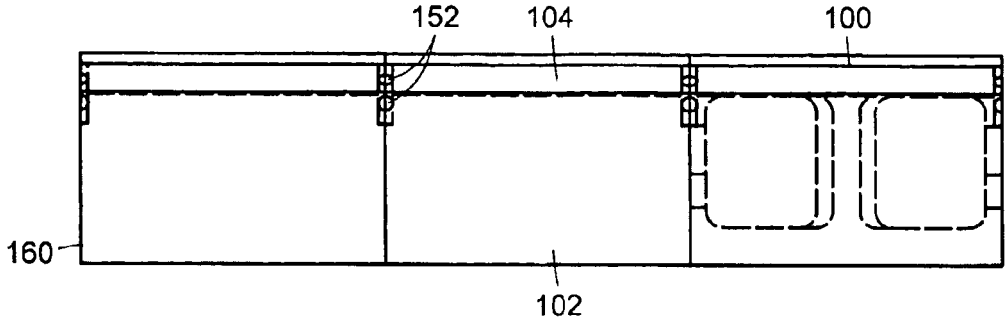
FIG. 10 is a front view of three grate blocks.

FIGS. 8, 9, and 10 show an alternative embodiment of a grate block 150. The grate block 150 has an upper wall 100, a front wall 102, and an angle corner wall 104, similar to the previous embodiment. In addition, it has a projection arm 106 and a hook 108. In contrast to the previous embodiment, instead of having a recess, the grate block 150 has a plurality of recesses 152, 154, and 156, wherein each recess has an opening 158 that extends through the side wall 160 and 162. The recess 152 directs the primary air at an angle of 30° above the horizontal plane and the recesses 154 and 156 direct the air perpendicular to the upper wall 100. Similar to the previous embodiment, in that the openings 158 are located on the side walls 160 and 162, the air needs to take a perpendicular turn prior to passing through the recesses 152 through 156 and into the combustion chamber 56, as seen in FIG. 1.

Figure 11:
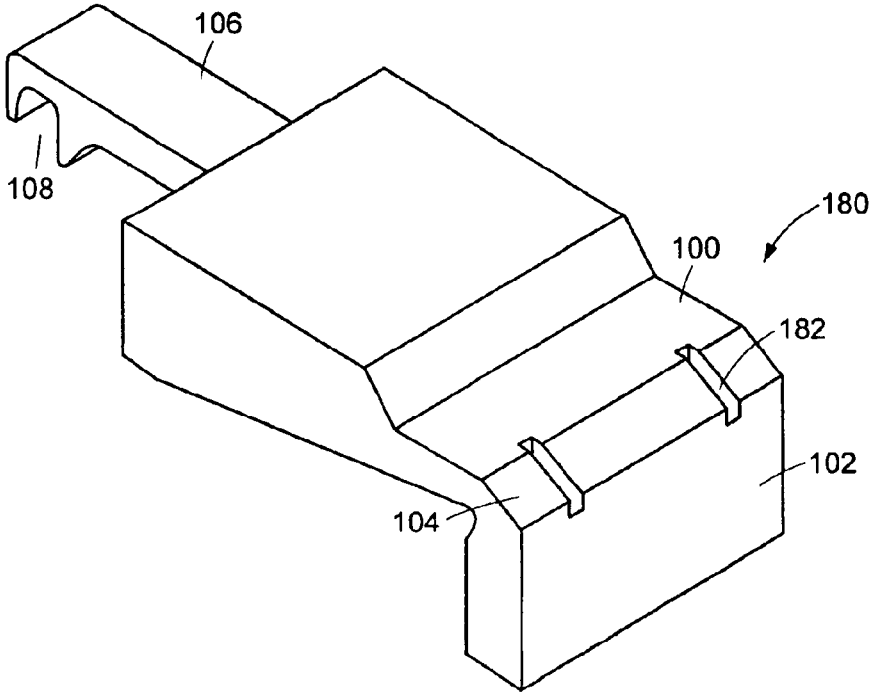
FIG. 11 is a perspective view of an alternative grate block.
Figure 12:
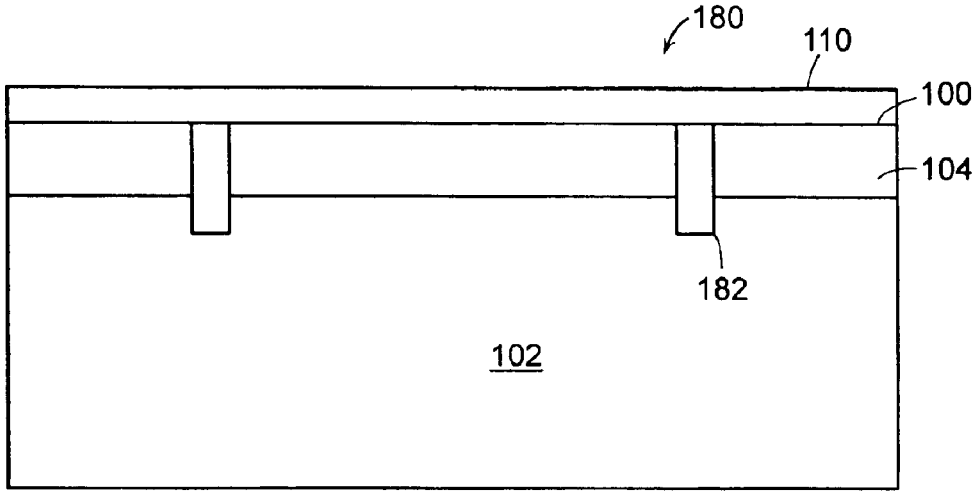
FIG. 12 is a front view of the grate block of FIG. 11.

Referring to FIGS. 11 and 12, an alternative embodiment of a grate block 180 is shown. The grate block has at least one groove 182 extending from the top wall 100 down at least a portion of the angle corner wall 104. The air directed up and outward from the grooves.

Figure 13:
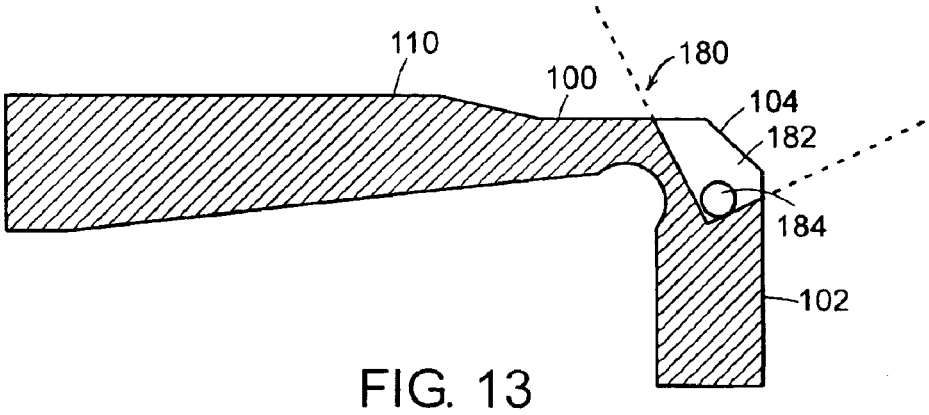
FIG. 13 is a sectional view of the grate block taken along lines 13—13 of FIG. 11.

FIG. 13 is a sectional view of a grate block 180 taken along lines 13—13 of FIG. 11. The groove 182 has one level. The grate block 180 has an opening 184 onto the groove through which air is forced. The walls 186 of the groove direct the air in a range from 20 degrees above the plane of the upper wall 100 to 110 degrees. It is recognized that the angles can vary so long so that it does not force air into the void created such as shown in FIG. 3B.

Figure 14:
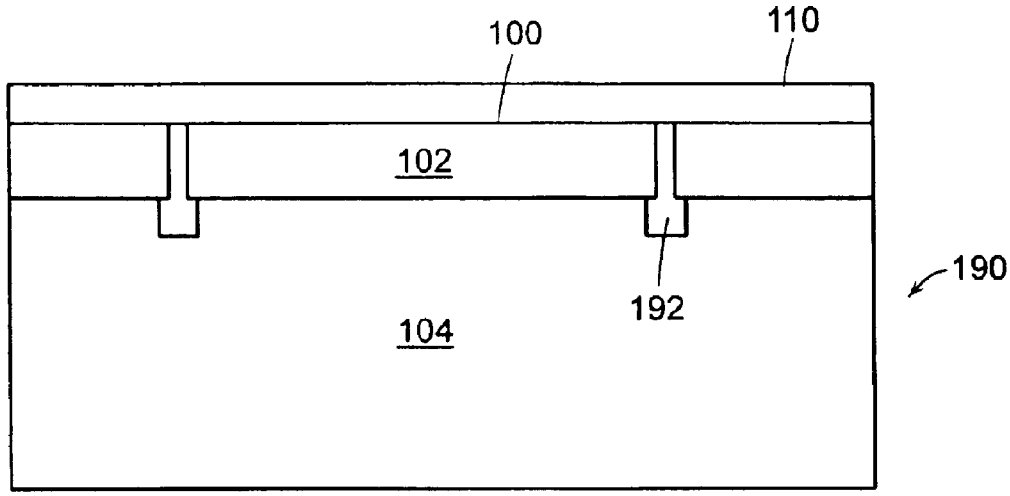
FIG. 14 is a front view of an alternative embodiment of a grate block.
Figure 15:
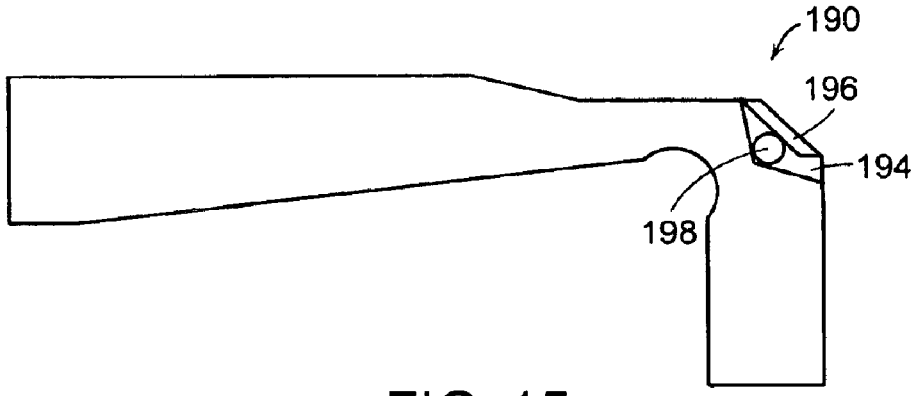
FIG. 15 is a sectional view of an alternative embodiment.

FIG. 14 is a front view of an alternative embodiment of a grate block 190. The grate block 190 similar to the grate block 40 shown in FIGS. 6A and 6B as a two level opening. In contrast to that of FIGS. 6A and 6B wherein the opening is in the recess on the side wall, the opening in the grate block 190 is a groove 192 having two levels 194 and 196 as best seen in FIG. 15. The deeper lower level 194 has an opening 198. Similar to the embodiment shown in FIGS. 6A and 6B, the two levels allow for self relieving for debris that falls within the groove.

Figure 16:
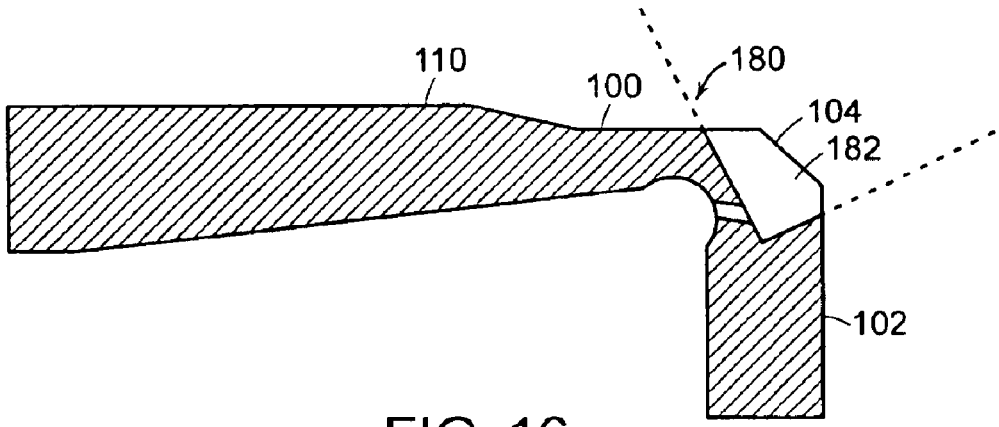
FIG. 16 is a sectional view of an alternative embodiment.

The embodiments shown have the opening being perpendicular to the motion of the moving block. Referring to FIG. 16, it is possible to have an opening that is in the direction of motion but angled such that it is not likely an item such as trash or ash included be forced into the opening because of the way the groove is formed. The groove also redirects the flow of air.

It has thus been necessary to devise a grate block which involves air flow passages which represent a substantial departure from its predecessors. Grate blocks in accordance with the invention are illustrated in FIGS. 4–7 and 8–10. The placement of the openings on the side walls of the grate block with the two level recesses, and the opening direction described above results in the air not being directed into a void and does not create a blacksmiths furnace. The elimination of this blacksmiths furnace results in the reduction of the ultimate high temperatures. In addition, the positioning of an angle results in dramatically reducing the likelihood of trash being placed and clogging the opening of the grate block. For example, the temperature in the combustion chamber are typically 1200° F. to 2200° F. The blacksmiths furnace created by the void and the directing of oxygen into that void results in temperatures in excess of 2000° F. in proximity to the grate. The void is covered by trash that does not collapse into the void because the size of the various components do not regularly allow the trash to fill into voids. As indicated above, this problem is more prevalent at the upper end of the grate where ash that is more likely to fill the void is not as prevalent and where there is more combustible material.

The grate blocks in the combustion furnace absorb particles from the trash and the ash as the fire burns. These particles can include minerals and metal such as copper, lead, potassium, zinc, and aluminum. Only those portions of the grate block that are exposed to the combustion furnace absorb the material therefore, portions such as underlying other grate blocks such as the projecting arm 106 does not absorb the material. These particles such as the metals listed contaminate the chrome-steel grate blocks, thereby affecting the micro structure of the alloy. Because of these, the grate blocks that have been used and therefore absorb the material, can not be melted down and recast because of these additional materials within the used grate blocks. While only the portions exposed to the combustion furnace contain these materials, the entire grate block must be discarded. At the projecting arm 106, the amount of material in a grate block is reduced by approximately 30 percent of material as seen in FIG. 5. This 30 percent reduction in material by the narrowing of the projection area which is not exposed to the combustion furnace therein reducing cost weight and the amount of material that must be disposed of when a grate block is eliminated.

The claims should not be read as limited to the described order or elements unless stated to that effect. Therefore, all embodiments that come within the scope and spirit of the following claims and equivalents thereto are claimed as the invention.

What is claimed:

1. A grate block for an incinerator, the incinerator including a plurality of rows of fixed grate blocks and a plurality of rows of movable grate blocks, the rows of fixed and movable grate blocks being arranged in a stepped configuration creating upper and lower rows relative to each other, the grate block comprising:

an upper wall having a top surface;

a front wall having a front surface extending from the top surface;

a pair of side walls each having an outer surface for engaging adjacent grate blocks and an inner surface, the side walls parallel to each other and spaced from each other, each outer side surface extending from the top surface and the front surface;

at least one of the side walls having a recess adjacent the top surface of the upper wall and also adjacent to the front surface of the front wall, the recess constructed and arranged to direct a stream of air upward, in a direction away from an adjacent, lower row of grate blocks; and at least one of the side walls having an opening between the inner surface and the outer surface for passage of a stream of air.

2. The grate block of claim 1 wherein the recess has an angle such that the stream of air exits from the grate block and forms an angle between 90° above the plane of the top surface and 140° surface below the plane of the top surface of the grate block.

3. The grate block of claim 1 wherein the recess has an angle such that the stream of air exits from the grate block and projects at an angle above 20° below the surface of the plane of the top surface of the grate block.

4. The grate block of claim 3 wherein the recess has an angle such that the stream of air exits from the grate block and forms an angle between 120° above the plane of the top surface and 14° below the surface of the plane of the top surface of the grate block.

5. The grate block of claim 1 wherein the recess has at least two levels, a shallow recess level and a deeper recess level, wherein the opening is on the deeper recess level, and the shallow recess level is interposed between the upper surface and the openings.

6. The grate block of claim 5 further comprising an angle corner edge surface interposed between the top surface, the front surface, and the pair of side surfaces.

7. The grate block of claim 6 wherein the recess has an angle such that the stream of air exits from the grate block and forms an acute angle between 90° above the plane of the top surface and 14° below the plane of the top surface of the grate block.

8. The grate block of claim 1 wherein the recess includes at least two distinct recesses on the at least one of the side surfaces, and an opening extending through each of the recesses.

9. The grate block of claim 1, wherein the recess is disposed in at least on of the sidewalls and extends from the top surface of the upper wall to the front surface of the front wall.

10. A grate block for an incinerator, the grate block comprising:

a top wall having a top surface;

a front wall having a front surface;

a pair of side walls, each side wall having an outer surface for engaging the adjacent grate block and extending from the top surface and the front surface;

an angled corner edge wall having an outer surface interposed between the top surface, the front surface, and the pair of side walls; and at least one groove formed in the angled corner edge wall, and an opening in the groove for the passage of a stream of air.

11. The grate block of claim 10 wherein the groove has an angle such that the stream of the air exits the grate block and forms an angle between 90° above the plane of the top surface and 14° below the surface of the plane of the top surface of the grate block.

12. The grate block of claim 10 wherein the groove has an angle such that the stream of air exits from the grate block and forms an angle between 120° above the plane of the top surface and 14° below the surface of the plane of the top surface of the grate block.

13. The grate block of claim 10 wherein the groove has at least two levels, a shallow groove level and a deeper groove level, wherein the opening is on the deeper groove level, and the shallow groove level is interposed between the upper surface and the opening.

14. The grate block of claim 13 further comprising a projecting arm extending from the top wall, the projecting arm defining a hook, the projecting arm narrowed from the width of the front wall.

15. An incinerator grate system comprising:

a plurality of rows of fixed grate blocks;

a plurality of rows of movable grate blocks, each row of movable grate blocks interposed between a pair of movable grate blocks;

a reciprocal mechanism connected to each of the rows of moveable grate blocks for moving the rows relative to the rows of the fixed grate blocks;

each of the rows having a plurality of grate blocks;

the grate blocks defining a cavity under the rows;

each of the grate blocks having an upper wall, a front wall, a pair of side walls, each side wall extending from the top wall and the front wall; and a foot carried by the front wall and engaging an upper wall of a grate block; the walls defining a cavity under the upper wall;

each of the side walls of the grate blocks engaging the side wall of the adjacent grate block, each side wall having a recess disposed in an interface where the front wall and upper wall meet such that the recess extends from the top wall to the front wall;

the recess defining a gap between the side walls of the adjacent grate blocks; and an opening through the recess of the sidewall for the flow of air from the cavity within the grate block.

16. The incinerator grate system of claim 15 wherein the recess on the side wall of the grate block has at least two levels, a shallow recess level and a deeper recess level, wherein the opening is on the deeper recess level, and the shallow recess level is interposed between the upper wall and the opening.

17. The incinerator grate system of claim 16 wherein the grate block further comprises an angle corner edge wall interposed between the top wall, the front wall and the pair of side walls.

18. The incinerator grate system of claim 17 wherein the recess has an angle such that the stream of air exits from the grate block and forms an angle between 90° above and 14° below from the top wall of the grate block.

19. The incinerator grate system of claim 15 wherein each side wall has at least three recesses, each recess having an opening through the side wall for flow of air from the cavity within the grate block.

20. The incinerator grate system of claim 19 wherein the grate block further comprises an angle corner edge wall interposed between the top wall, the front wall and the pair of side walls.

21. The incinerator grate system of claim 20 wherein at least one recess on the side wall extends to the front wall, at least another recess on the side wall extends to the top wall, and at least another recess on the side wall extends to the angle corner edge wall.

22. A method of incinerating refuse comprising the steps of:

providing a grate having a plurality of fixed rows and a plurality of moving rows of grate blocks;

moving the moving rows of grate blocks in a back and forth motion to move the refuse along the grate;

creating a void in the refuse by movement of the moving row;

forcing air through an opening in the grate block to the refuse and away from the void; and directing the air through an opening in the sidewall of the grate block and redirecting the air prior to passing the sidewall.

* * * * *

UNITED STATES PATENT AND TRADEMARK OFFICE

CERTIFICATE OF CORRECTION

PATENT NO. : 6,964,237 B2
DATED : November 15, 2005
INVENTOR(S) : Mark P. Hepp

It is certified that error appears in the above-identified patent and that said Letters Patent is hereby corrected as shown below:

Column 10,
Line 62, "140°" should read -- 14° --.

Signed and Sealed this

Seventh Day of February, 2006

JON W. DUDAS
*Director of the United States Patent and Trademark Office*